United States Patent [19]

Hicks

[11] 4,026,070

[45] May 31, 1977

[54] ADJUSTABLE DOOR

[76] Inventor: Harry H. Hicks, 1599 Knollstone, Ferguson, Mo.

[22] Filed: Mar. 31, 1975

[21] Appl. No.: 563,314

[52] U.S. Cl. ..... 49/55; 49/503

[51] Int. Cl.[2] ..... E06B 9/06

[58] Field of Search ..... 49/55, 56, 501, 503; 160/372, 374; 403/6, 7, 260, 297, 374

[56] References Cited

UNITED STATES PATENTS

| | | | |
|---|---|---|---|
| 935,673 | 10/1909 | Miller | 49/55 |
| 1,662,117 | 3/1928 | Kuhl | 49/55 X |
| 1,873,229 | 8/1932 | van Dresser | 49/55 |
| 2,755,525 | 7/1956 | Minot | 49/55 |
| 3,299,596 | 1/1967 | Neal et al. | 49/501 X |
| 3,738,062 | 6/1973 | Ughi | 49/55 |
| 3,832,805 | 9/1974 | Stevens | 49/503 |

FOREIGN PATENTS OR APPLICATIONS

| | | | |
|---|---|---|---|
| 592,789 | 8/1925 | France | 403/374 |

*Primary Examiner*—Paul R. Gilliam
*Assistant Examiner*—David H. Corbin
*Attorney, Agent, or Firm*—Rogers, Eilers & Howell

[57] ABSTRACT

An adjustable security barrier comprising three sections whose relationship to each other can be adjusted to expand or contract the area covered by the security barrier. The barrier uses hidden wedge nuts, with bolts to secure the sections together. The bolts and nuts are inaccessible when the barrier is in the locked position. A sliding rod is adapted to be inserted into a hole in the passageway so that the barrier can be locked into place by the use of a padlock. Hinged mounting plates allow free swinging motion of the barrier. The hinges and mounts are inaccessible when the barrier is in the locked position.

11 Claims, 18 Drawing Figures

ADJUSTABLE DOOR

BACKGROUND OF THE INVENTION

1. Field of the Invention

This invention relates to improvements in security barriers attached in passageways. The invention is more particularly concerned with, but not limited to, adjustable security doors that are adjusted by the use of interacting tubular rods and wedge nuts, with connecting parts being hidden when the door is secured so as to be inaccessible, with a sliding bolt which interacts with the door frame keeping the door from being opened or removed, and with door mounting plates which increase the swing area of the security door.

2. Features of the Invention

It is a primary object of the invention to provide one security barrier arrangement, the width of which can be set so that the one barrier can be adapted to different passageway widths. Particularly, an object is to provide such a security barrier that retains full security despite also having such adjustability. A further object is to make such a barrier from conventional tubular rod and bar steel.

IN THE DRAWINGS

DESCRIPTION OF THE INVENTION

Figure 1:
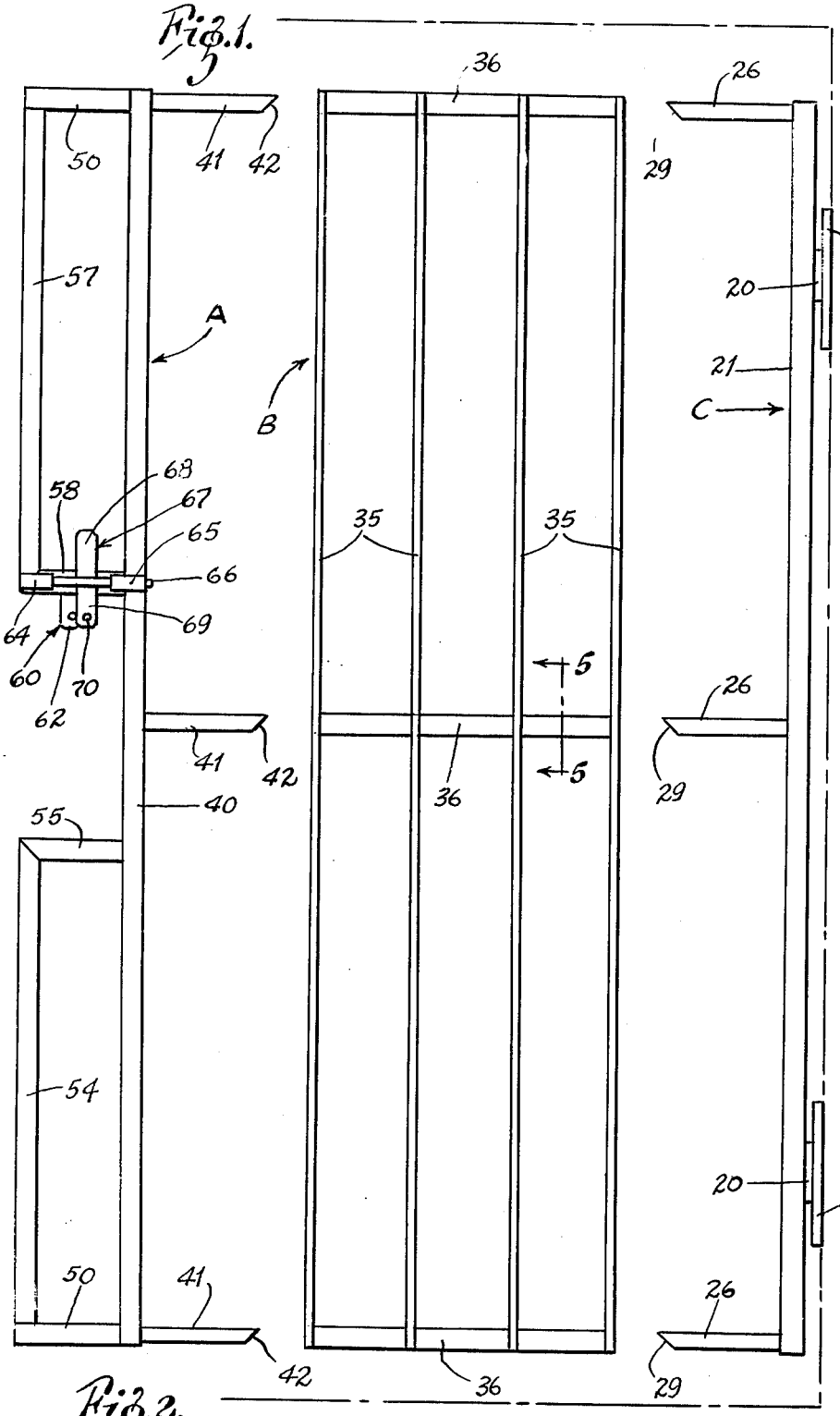
FIG. 1 is an expanded elevation of the security door.
Figure 3:
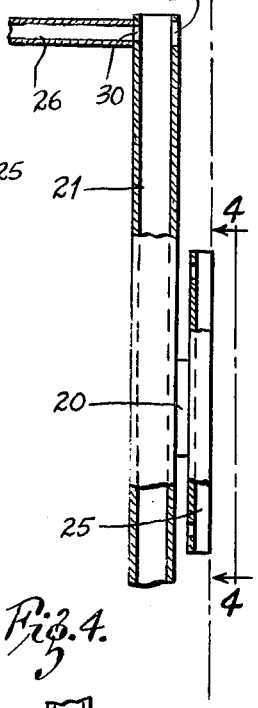
FIG. 3 is an enlarged elevation, partly in section, of the upper right corner of FIG. 1.
Figure 4:
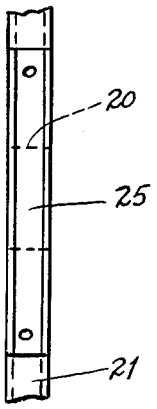
FIG. 4 is an elevation of a hinge block, taken on the line 4—4 of FIG. 3.

Referring to FIG. 1, the security door is seen to consist of a side section C which fits into a middle section B, and also a side section A, which also fits into section B. Section C has two hinges 20, which can be butt hinges with plates permanently hinged together as by a rivet. One plate of each hinge 20 is fastened securely, as by a weld, to the square tubular rod 21 which is the longitudinal vertical or upright member of section C. The other plate of each hinge 20 is fastened, as by a weld, to a plate such as a channel 25 on the side opposite the channeled side. This channel is adapted to be secured, as with bolts, to a longitudinal side of a rectangular door frame, (shown diagrammatically in dashed lines) with its open or channeled face abutting the door frame. The bolts can be countersunk in the channel, if desired. The channel face can also be on the side opposite the door frame with the bolt heads located between the channel walls. This allows the hinge plate attached to the channel to sit out from the door frame, so that it can locate the security door beyond any other projection from the door frame that is no deeper than the channeled space of the rod 25, such as the storm door frame. This arrangement allows full opening of the security door, despite such projections. The use of the channel, which extends above and below the hinge 20, also allows for larger and stronger bolts to be used to secure the hinge plate than could be used if only the hinge plate were attached to the door frame. The security barrier may be used in other passageways or openings besides door frames, such as windows or tunnels.

Although two hinges are illustrated, a greater number of hinges can be used, if so desired. Section C has pronged members 26, formed of square tubing that are welded perpendicularly, to the upright 21 and parallel to each other. When the section C is swung to a position with the prongs 26 parallel to the door frame plane, the bolts that secure the channel 25 to the door frame are inacessible due to their proximity to the tubular rod 21, so that a burglar cannot remove them by normal methods.

Figure 10:
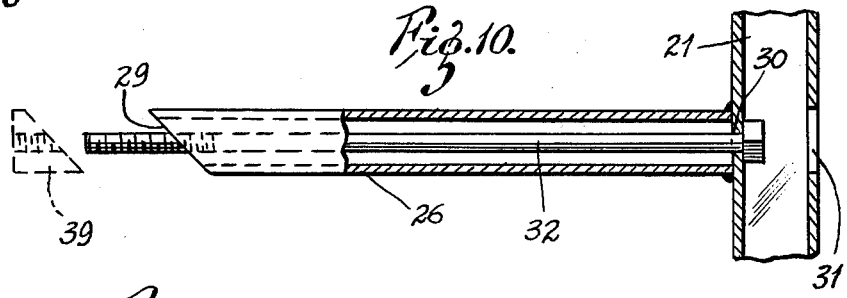
FIG. 10 is an enlarged elevation, partly in section, of the middle of side C on the right of FIG. 1, and a bolt and wedge nut.

One end of each prong 26 is secured to the upright 21 as by weld, while the other end of the prong 26 has a slanted tip 29 (FIG. 10). There are two aligned openings in the upright 21 for each prong 26. One smaller opening 30 in the upright 21 is located on the side where a prong member 26 is attached at the center of the section that the prong member intersects, to receive the pin of a bolt 32, but not to allow the passage of the bolt head. The other larger opening 31 is at the opposite side of the longitudinal tube 21 from the opening 30, and is aligned with the opening 30 to allow passage of the bolt 32. When the pin of the bolt 32 is inserted through the openings 30 and 31, and the head of the bolt 32 abuts the interior wall of the rod 21 surrounding the opening 30, the threaded end of the bolt pin extends beyond the slanted tip 29 of the prong 26. Section C is shown with three pronged members 26; however, a greater number of prongs can be used, or as few as one prong can be used.

Figure 5:
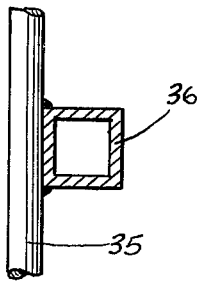
FIG. 5 is a section on the line 5—5 of FIG. 1.
Figure 17:
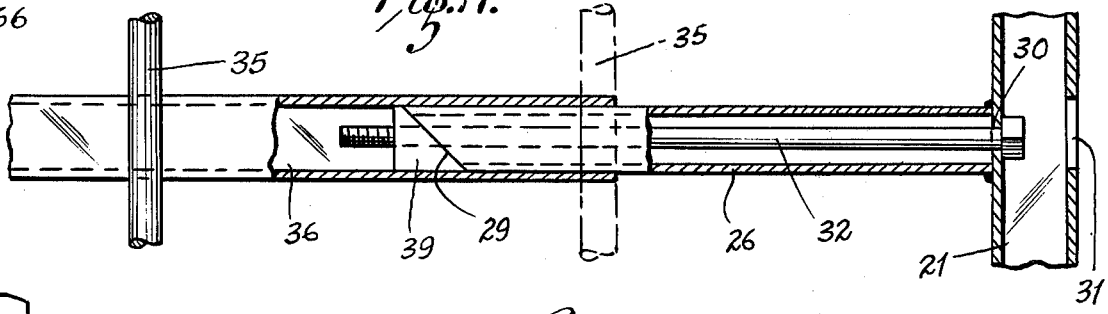
FIG. 17 is an enlarged elevation, partly in section, of the right middle portion of FIG. 11.

The center section B is comprised of four vertical rods 35 which are securely attached, as by welding, to three horizontal square tubular rods 36 (FIGS. 1, 5). The square tubular rods 36 are designed to telescopically snugly receive the prongs 26 of Section C (FIG. 17).

A slanted square-shaped nut 39 is threaded onto each bolt 32 so that its slanted surface may contact the slanted surface of the prong tip 29, and may be inserted with the associated prong 26 non-rotatably into the horizontal tube 36 of the center section. As will appear, tightening of the nuts on the bolts binds the prongs in the several horizontal tubes 36.

Figure 2:
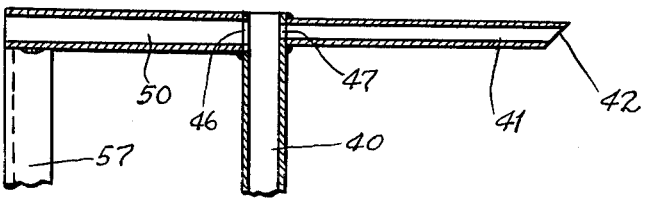
FIG. 2 is an enlarged vertical medial section at the upper left corner of FIG. 1.
Figure 6:
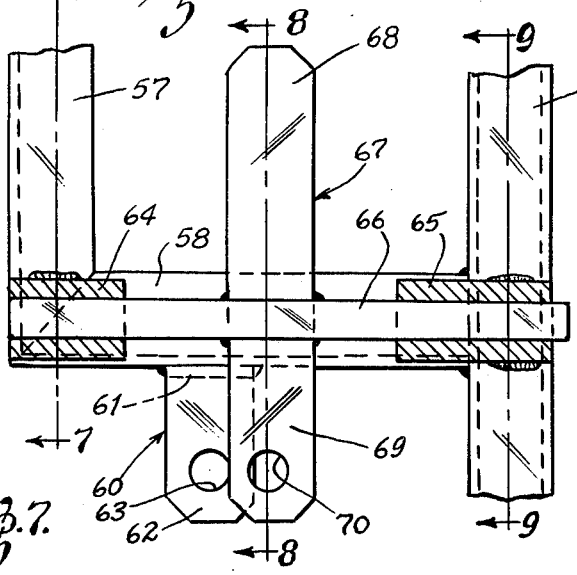
FIG. 6 is an enlarged view, partly in vertical section, of the bolt brackets, taken at the left of FIG. 1.
Figure 8:
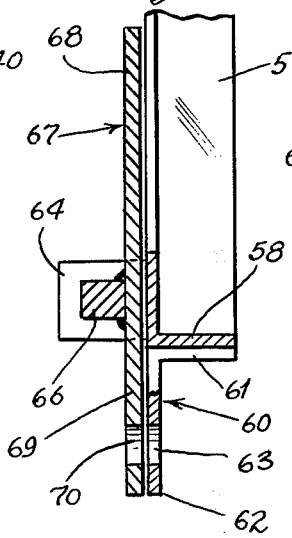
FIG. 8 is a section on the line 8—8 of FIG. 6.
Figure 9:
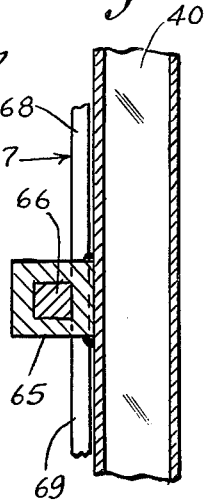
FIG. 9 is a section on the line 9—9 of FIG. 6.
Figure 7:
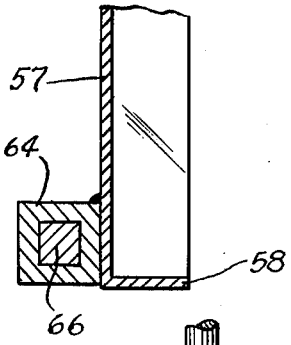
FIG. 7 is a section on the line 7—7 of FIG. 6.
Figure 18:
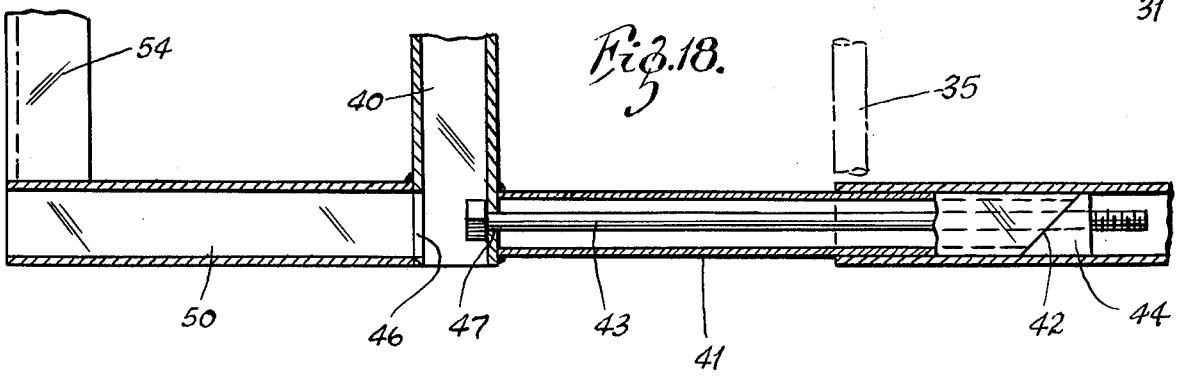
FIG. 18 is an enlarged elevation, partly in section, of the lower left corner of FIG. 11.
Figure 11:
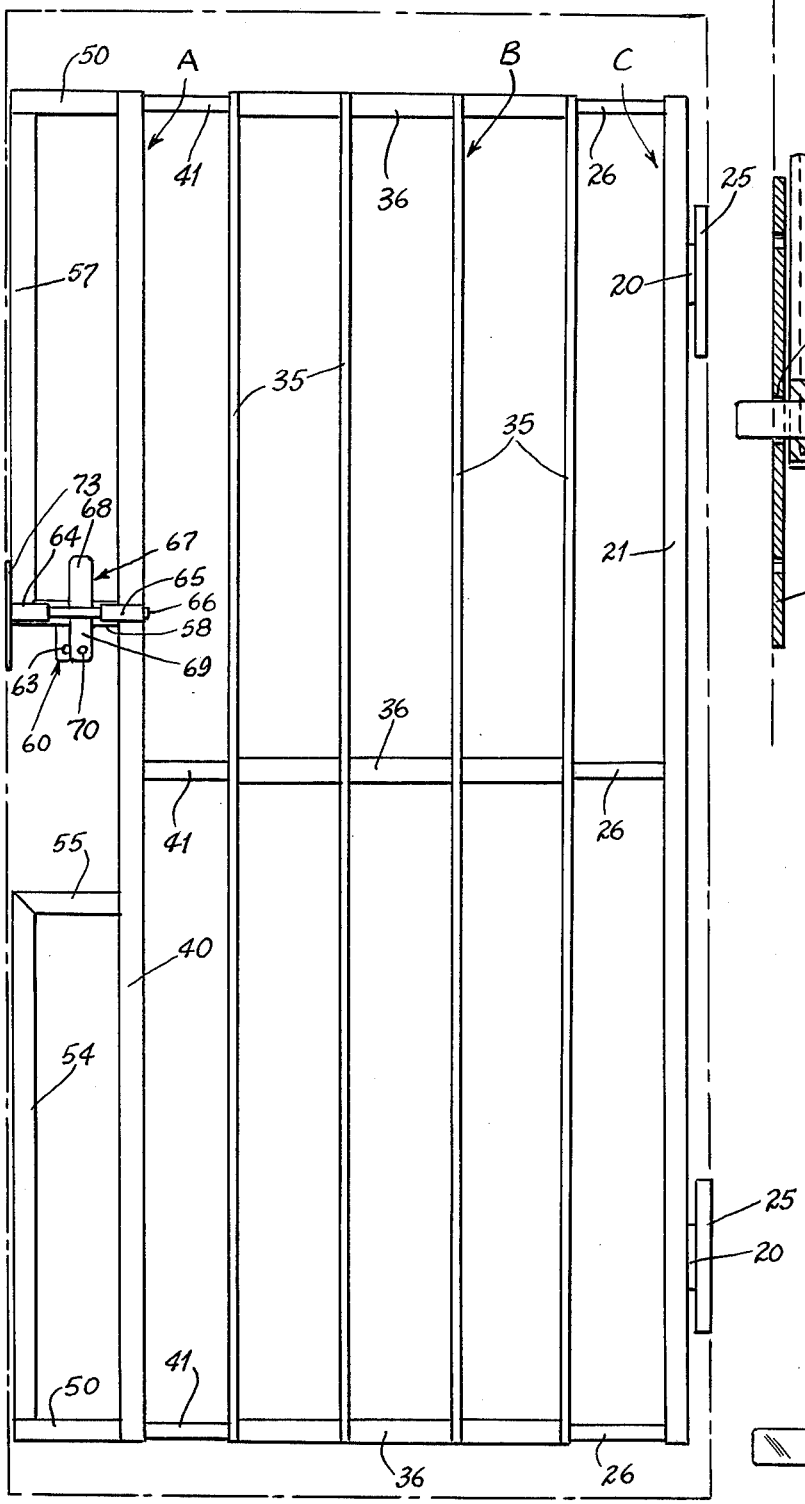
FIG. 11 is an elevation of the security door as assembled.
Figure 12:
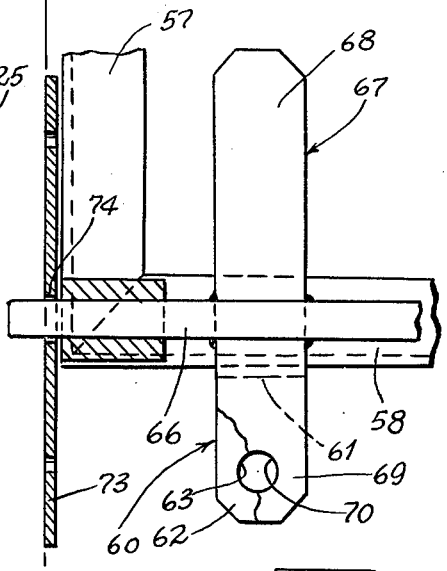
FIG. 12 is an enlarged view, partly in section of the bolt group and keeper, with the bolt in the lock position.

Section A likewise has a square-tubed upright 40 from which project three square-tubed pronged members 41 each with a slanted tip 42. The pronged members 41 are secured to the upright 40 as by welds. These prongs receive bolts 43 with square sloping nuts 44, as with section C; and may be inserted into the horizontal tubes 36 of section B and secured there by tightening of the bolts 43, as above. There are openings 46 and 47 (FIGS. 2, 18) in the upright 40 adjacent each prong 41.

On each of the two ends of the upright 40 of section A a square tubular rod 50 is welded in alignment with the openings 46 and 47 in the member 40. The bolts 43 are then inserted through the hollow rods 50 and through the openings 46 and 47 of the upright 40 so s to project beyond the prongs. As in section C, the opening 46 is large enough to allow the passage of the bolt, whereas the hole 47 passes the shank but prevents the passage of the bolt head. It is noted that the middle prong 41 of section A does not have a horizontal hollow rod aligned with it and connected to the rod 40 so the bolt is inserted through it in the same manner as in section C.

A squared slanted nut 44 is threaded onto each bolt 43 with the slanted surface of the nut 44 toward the sloping end 42 of the pronged member 41. The prongs 41 are then inserted the desired distance into the tubes 36, and the bolts 43 and nuts 44 are tightened.

The frame of section A is further composed of a lower vertical angle 54 which is welded to the end of the lower tubular rod 50 and extends upwardly to where it is cut, bent at right angles and welded to provide a horizontal part 55 perpendicular to and welded to the upright rod 40.

At the upper part of section A there is a similar lateral extension. The upper horizontal tube 50 has a vertical angle 57 welded to and extending downwardly from it to where it is cut, bent at a right angle and welded to provide a horizontal part 58 perpendicular to and welded to the upright rod 40.

The upper extension incorporates a lock bolt or rod (FIGS. 6, 7, 8, 9, 12 and 14). To this end an angular steel plate 60 has a horizontal portion 61 welded to the bottom side of the horizontal angle 58 so that the portion 62 thereof extends downwardly vertically. A circular hole 63 is provided in the bottom portion of the plate 60. The bolt or rod of the lock is attached to the front side of the angle 58. There is a square tube 64 welded to the far frontal side of the angle 58, and the bottom end of the angle 57, and a square tube 65 welded to the front side of the other end of the angle 58 and to the upright tube 40. They slidably receive the ends of a rod 66 to which a vertical plate 67 is attached. The plate 67 extends upwardly at 68 to constitute a lock handle by which the rod may be slid open and closed; it has also a depending portion 69 having a hole 70. The depending portion can move into back-to-back relation to the leg 63 of the member 60, in which position the holes 63 and 70 are aligned to receive a padlock.

Figure 13:
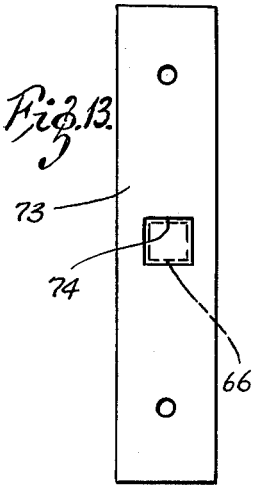
FIG. 13 is an elevation of the keeper plate taken from the left edge of FIG. 11.
Figure 14:
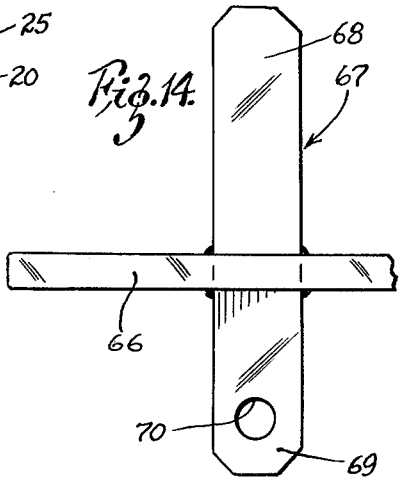
FIG. 14 is an elevation of the bolt and bolt plate.
Figure 15:
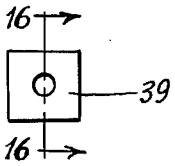
FIG. 15 is an enlarged elevation of a wedge nut looking from the right side of FIG. 16.
Figure 16:
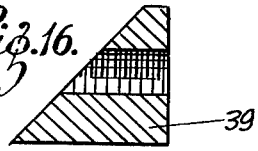
FIG. 16 is a section on the line 16—16 of FIG. 15.

The tubes 64 and 65 are open at both ends so that the lock rod 66 may slide with the plate 67 between the tubes. The left end of the rod 66 is designed to slide into a hole provided into the longitudinal side of a door frame, covered by a metal keeper 73 having a square hole 74 to receive the bolt (FIG. 13). The keeper is attached to the longitudinal side of the door frame as with screws that are inaccessible when the door is closed.

OPERATION AND ASSEMBLY

The security door is assembled by placing the channel plate 25 for each hinge against the side of the door frame with its open or channeled side abutting the door frame, and bolting it to the door frame. The hinges 20 may be so attached to the channeled plates 25 and the tubular rod 21, that the section C may swing open and closed with respect to the door frame. The channeled plates 25 allow the hinges 20 attached thereto to sit out away from other projections shallower than the channels, so that section C may pivot open to at least 90 degrees to the door frame.

Either as a pre-assembly before mounting the section C onto the door frame, or afterward, the bolts 32 are passed through the openings 30 and 31 in the upright 21, until the heads of the bolts 32 engage the upright, whereupon shanks of the bolts pass through and extend beyond the hollow prongs 26. The slanted square wedge nuts 39 are loosely threaded onto the bolts 32.

Section B, with its horizontal tubular rods 36 and its vertical rods 35 secured by welds, is then interlocked with section C by inserting the prongs 26, nuts 39 and bolts 32 the desired distance into the horizontal tubular rods 36 of the center section B. The distance of insertion of the prongs 26 into the tubes 36 is usually predetermined by measurement of the width of the opening to be covered by the secuirty door. After the pronged members 26 are inserted in the tubes 36, the two sections C and B are interlocked by tightening the bolts 32 by a socket wrench inserted through the holes 31 and thus bringing the nuts 39 into contact with the slanted surfaces 29 of the prongs 26. If this is done with the section C in place in the door frame, that section is moved to open position, which exposes the bolts 32 to socket wrenches. These bolts are inaccessible when the door is closed. The nuts 39 cannot turn in the tubes 26 because of their complementary non-circular sections. When the sloping surfaces of the nuts 39 are forced against the sloping ends 29 of the prongs 26, the nuts 39 are pushed downward and the slanted tips 29 pushed upward so that they are wedged firmly in the tube 36, and prevent further movement of the prongs 26 into or out of the tubes 36.

With sections C and B thus secured together, section A is then secured to section B. A bolt 43 is inserted through each of the two horizontal tubular rods 50 and connected squared tubes 31, which are welded to the upright member 40 of section A. The bolts 43 pass through the horizontal tubes 50 until the heads of the bolts engage the wall of the upright 40 adjacent the hole 47. This allows the threaded end of the bolts 43 to extend beyond the slanted ends 42 of the prongs 41. A bolt 43 is inserted through the middle prong 41 of section A in the same fashion as the bolts 32 were inserted through the prongs 26 of section C. The slanted wedge nuts 44 are then attached to the threaded portions of the bolts 43, and the prongs 41 are inserted into the three tubular rods 35 of the middle section B, to the desired position. When this desired position is attained, the bolts 43 are tightened so as to effect the wedging action of the slanted tips 42 of the prongs 41 and the wedge nuts 44 as previously described. The distance of insertion is normally predetermined as before. However, the arrangement permits ready final adjustments of the width of the door. Other assembly procedures are evident, including complete pre-assembly by measurement ahead of mounting, with necessary final adjustments at the site after mounting. The door is thus capable of being adjusted to fit in doorways of various sizes. After it is used in a doorway of one size, it can be removed and readjusted so as to fit in a doorway of a different size.

For the locks, a hole is provided in the door frame in line with the rod 66. The keeper plate 73 is attached to the door frame so that its opening 74 is aligned with the hole in the door frame. When the door is closed, the handle 68 may be moved to slide the rod or bolt 66 into the keeper hole 74. The sliding of the rod 66 is controlled by the short hollow tubes 64 and 65. This rod is projected until the hole 70 of the plate 67 is aligned with the hole 63 of the plate 60 with the two plates having a close clearance and with the bolt in front of the two plates. When these bores are so aligned, a padlock is inserted through them and locked, so as to prevent the movement of the plate 67 and thus the rod 66, preventing the end of the rod 66 from being removed from the hole in the door frame. The security door thus cannot be opened or shut until the padlock is removed from the two bores 63 and 70.

With the door so assembled, the bolts used to secure various parts to one another are inaccessible because of their close proximity to the components of the gate, which interfere with any attempt to remove the bolts. A cover plate may be welded or secured from the inside over the space between the angle 55, the upright 40 and the angle 58, to render the lock mechanism inaccessible from the outside. This can be used when access from the outside if not required.

Because of the versatile nature of the hinges 20 and the channeled plate 25, the door may be assembled so as to hinge on either side of the door frame, and be installed so as to open toward either side of the door frame. A righthand door can use all the same parts as a left-hand door, by simply turning the door upside down. At most, only the side section C need be changed. A minimum number of different parts are required, as is evident by considering that it uses square tubes of only two sizes, conventional angle and bar stock, and a small amount of conventional strip for the lock parts.

Various changes and modifications may be made within this invention as will be readily apparent to those skilled in the art. Such changes and modifications are within the scope and teaching of this invention as defined by the claims appended hereto.

What is claimed is:

1. A security barrier adapted to fit and render secure passageways of a variety of sizes comprising a plurality of barrier elements forming a grid type structure, means to fasten the barrier elements in a secure access-barring relationship to the passageway, adjustment means for adjustment of the barrier elements relative to each other and to the passageway to allow fitting of the barrier to the passageway, and means for fixing of the elements together in adjusted positions relative to each other to form a rigid barrier of a suitable size for the passageway, the fastening means and the fixing means being accessible when the barrier is in non-access-barring relationship to the passageway, means rendering the fastening means inaccessible when the barrier is in an access-barring relationship to the passageway, and means rendering the fixing means inaccessible when the barrier is in an access-barring relationship to the passageway.

2. The barrier of claim 1 wherein the fastening means includes at least one bolt to join the barrier to a passageway, and the means rendering the fastening means inaccessible includes means obstructing access to the bolt from the outside of the barrier when the barrier is in access-barring position.

3. The barrier of claim 1 including a locking mechanism comprising a rod attached to the barrier with the rod having means mounting it on the barrier to slide relative to the barrier for engagement and disengagement in the opening.

4. The barrier of claim 1 wherein the barrier elements and adjustment means comprise an outer barrier element and an inner barrier element, the outer barrier element having a tubular edge member and tubular transverse members secured end-on to the edge member; the inner barrier element having grid members including tubular transverse members sizes to telescopically receive the transverse members of the outer barrier element; the outer element having outer and inner aligned holes through it in alignment with at least one of the tubular tranverse members, the outer hole being larger than the inner, the fixing means including a bolt with its shank through the aligned holes and through and beyond the transverse member into the transverse member of the inner barrier element, the head of the bolt passing through the larger opening but not the smaller, a nut on the bolt non-rotatably held in the transverse member of the inner barrier element and engageable against the end of the transverse member of the outer barrier element, the engaging ends of the bolt and transverse member being shaped to deflect the nut laterally to bind against the outer member when the bolt is tightened, so as to fix the two barrier elements together, the larger opening of the outer element being through the edge of the edge member so as to be inaccessible when the barrier is in access-barring relationship to the passageway.

5. A security barrier adapted to fit and render secure passageways of a variety of sizes comprising a plurality of barrier elements with a first group of barrier elements aligned in one direction and a second group of barrier elements aligned transversely to the first group of elements, means to fasten the barrier elements in a secure relationship to a passageway, the transverse elements having means permitting adjustment of the barrier elements relative to each other and to the passageway to allow fitting of the barrier to the passageway comprising a plurality of sets of telescoping tubes, at least one set of telescoping tubes having a bolt passing through the inner tube and threaded into a slanted wedge nut, with a sloped surface at the end of the inner tube causing the wedge nut and inner tube to wedge outwardly in the outer tube to fix the barrier in a preselected size; the fastening means comprising a plate hinged to the barrier and to receive bolts that can pass through the plate and secure the plate to the passageway, the plate being placed to cause the barrier to overlie the plate and to block access to the fastening means when the barrier is moved to the closing position; means rendering the adjustment means inaccessible when the barrier is in a closing relationship to a passageway comprising an opening in at least one of the first elements, the opening communicating with an inner telescoping tube and having the bolt recessed within the first element so that a wall of the first element blocks access to the bolt when the barrier is in a closing relationship to a passageway, and a locking mechanism comprising a rod attached to the barrier and adapted to slide relative to the barrier into an opening in the passageway causing the position of the barrier to be locked relative to the passageway.

6. In a security barrier for door openings and the like; a first vertical side section having vertical support means and horizontal tubular members, one adjacent the top and one adjacent the bottom, the vertical support means having a channel-like cross section with its open side adapted to be placed toward the jamb of the door opening; a second vertical side section having vertical support means and two horizontal tubular members for telescoping interengagement with those of the first vertical section; screw means for securing the horizontal members in a suitable adjusted relationship, the screw means extending from inside the channel of the vertical support means of the first side section inwardly inside of and into the telescoped horizontal tubular members, and being surrounded by the channel section, except at its open side whereby to be rendered inaccessible by the opening when the barrier is in closing position relative to the opening, the channel section of the first side section being open adjacent the screw means to make the screw means accessible when the barrier is open.

7. In the security barrier of claim 6, a third section having like telescopic interengagement with the opposite side of the first vertical section, and like screw means for securing the same in adjusted relationship.

8. In the security barrier of claim 7, hinge means attached to one of the second and third sections, the hinge means having portions adapted to receive fastening devices engageable with the opening, such portions being accessible when the barrier is opened but being covered by the vertical support means when the barrier is closed, whereby the hinge means may be secured to a jamb when the barrier is opened, but are concealed when the barrier is closed.

9. In the security barrier of claim 6, hinge means on the second vertical section, the hinge means having portions to cause the hinge to stand out from a jamb to enable the barrier to swing freely open.

10. In the barrier of claim 7, the first section being symmetrical and the telescoping members on the second and third sections being the same, whereby either second or third section may be mounted on either side of the first section; the second section having hinge means on it, and the third section having latch means, the arrangement being such that the barrier may be hinged at either side.

11. In the security barrier of claim 8, the several sections being made up of spaced vertical and horizontal members that make the barrier of a grid type construction.

* * * * *